US005164211A

United States Patent [19]

Comer

[11] Patent Number: 5,164,211

[45] Date of Patent: * Nov. 17, 1992

[54] EXPANDABLE BONE PLASTIC CAP FOR MEAT

[76] Inventor: Robert E. Comer, 1228 42nd Ave., Greeley, Colo. 80634

[ * ] Notice: The portion of the term of this patent subsequent to Aug. 13, 2008 has been disclaimed.

[21] Appl. No.: 708,705

[22] Filed: May 31, 1991

Related U.S. Application Data

[63] Continuation-in-part of Ser. No. 443,664, Nov. 29, 1989, Pat. No. 5,039,533.

[51] Int. Cl.[5] ..... B65D 85/00

[52] U.S. Cl. ..... 426/129; 426/124; 426/392

[58] Field of Search ..... 426/129, 124, 127, 392, 426/412, 413, 410, 396; 53/432, 434, 433; 229/25 R

[56] References Cited

U.S. PATENT DOCUMENTS

| | | | |
|---|---|---|---|
| 4,029,822 | 6/1977 | Comer | 426/124 |
| 4,136,205 | 1/1979 | Quattlebaum | 426/412 |
| 4,267,960 | 5/1981 | Lind et al. | 299/55 |
| 4,534,984 | 8/1985 | Kuehne | 426/127 |
| 4,863,784 | 9/1989 | Lustig et al. | 428/218 |

FOREIGN PATENT DOCUMENTS

| | | | |
|---|---|---|---|
| 1397648 | 6/1975 | United Kingdom | 426/129 |

*Primary Examiner*—Steven Weinstein
*Assistant Examiner*—Anthony Weier
*Attorney, Agent, or Firm*—Norvell E. Von Behren

[57] ABSTRACT

An expandable bone plastic cap for meat such as beef, pork, lamb, poultry and the like. The cap is formed with at least one or more separate sheets of material in the approximate shape of portions of the meat and is designed to cushion exposed bone portions from piercing the oute vacuum sealed bag surrounding the meat. The cap is formed in one embodiment in two separate juxtaposed shapes tacked together with holes or slits cut through both shapes. As the outer bag has air removed, during the vacuum sealing, it collapes on the bone plastic cap which in turn collapses on the meat. The separate prefromed shapes collapse independently and slide upon each other with the inner shape forming the primary cushion and the outer shape forming a backup cushion. Bridging of concave areas by the bone cap is eliminated reducing growth of bacteria in these areas. The bone plastic cap may also be formed in other embodiments such as in a single sheet or in multiple sheet configurations and is formed with expansion means such as pleats and/or corrugations to permit the cap to be positioned over larger oversized cuts of meats. The expansion means may be formed in the single sheet configuration as well as in the multiple sheet configurations of two sheets, three sheets and others.

23 Claims, 3 Drawing Sheets

EXPANDABLE BONE PLASTIC CAP FOR MEAT

CROSS REFERENCE TO RELATED APPLICATIONS

This application is a continuation-in-part of the applicant's patent application, Ser. No. 07/443,664 which was filed on Nov. 29, 1989 and entitled "Bone Plastic Cap for Meat," and which issued as U.S. Pat. No. 5,039,533 on Aug. 13, 1991.

BACKGROUND OF THE INVENTION

This invention relates generally to a cushion device for packaging meats and more particularly to a new and novel bone plastic cap that is positioned over exposed bone areas to cushion the area to prevent the exposed bone portions from piercing the outer vacuum sealed bag and also to eliminate bridging of areas where bacteria can grow faster than desired.

In the modern-day processing of freshly killed meat, problems occur during the packaging process where vacuum sealing of the meat in an outer bag is employed. Large cuts of meat are often processed for sale to a butcher rather than to the ultimate retail consumer. The local butcher then re-cuts the meat for display and resale to the purchasing public. Since these various types of meat cuts can be quite large and can vary in shape and in the cut of meat, the problem of preserving the cut in an outer vacuum bag manifests itself whenever an exposed bone portion tears the outer vacuum sealed bag. Portions of exposed bone can protrude from various places in the meat cut and may pierce the outer vacuumed bag. The destruction of the vacuum seal caused by the exposed bone pieces permits entry and rapid growth of bacteria in the package, thus reducing the shelf life of the meat. The visible evidence of bacteria growth is very apparent and can destroy the fresh appearance of the package of meat.

In order to overcome this major potential bone puncture problem, prior art solutions have attempted the use of separate cushions over the exposed bone area with a cloth material impregnated with wax or other soft pliable materials to accomplish a protective padding. Still other cushions have been tried using flat sheets of plastic material over the bone area. Both of the above have a distinct disadvantage of being labor intensive in application. The beeswax coated cushions did not permit the viewing of meat underneath the padding since it is not transparent. In addition, most types of padding did not solve the problem of eliminating the bridging pockets of entrapped air. Separate smaller cushions were labor intensive to apply and difficult to keep in place over the exposed bone portions during insertion into the outer vacuum sealed bag.

In addition to the above problem, certain types of meat are cut so that large concave areas of indentation occur. As a result, the protective packaging material may bridge the area creating pockets of air in which bacteria can also grow quite rapidly. This bridging and consequent air entrapment further reduces the shelf life of the meat. An important function of this invention is to reduce the likelihood of bridging by designing and thermal forming a plastic part that roughly conforms to the cavities and contours of the cut of meat. Elimination of all entrapment of air is an important intent of the invention.

For a more detailed discussion of the problems using prior art cushion devices, reference should be made to the applicant's U.S. Pat. No. 4,029,822, issued on Jun. 14, 1977. The above patent also details an attempted solution to the problems using a solid one-piece bone shield that was formed of a low density polyethylene plastic with a 12½% ethylene, vinyl acetate blend. This particular material was readily available in the period between 1970 and 1980. The previous bone shield was somewhat rigid as formed and contained preformed grooves between pleats that defined channels which were designed to carry meat juices. The plurality of pockets in the bone shield were also designed to trap the fluids that were squeezed from the meat and to produce the fluid-filled cushions to provide protection at the exposed bone areas.

This attempted solution, while appearing satisfactory in theory, did not practically operate as designed and was later replaced by the applicant's new and novel bone plastic cap of the present invention. Another problem soon surfaced in attempting to solve the problems before described. In order to obtain a better protection on the exposed bone portions, it was felt that a thicker cushion could be used. The gage was 0.015 mils. This thicker material of approximately 0.015 gage possessed a memory that had an inherent inclination to balloon away from contact with the meat surface if the outer bag lost its vacuum thus permitting occasion for further bacterial growth. However this led to the bridging problem becoming more severe. Whenever a thicker material was used to cushion exposed bone, the bridge became stronger and could not collapse tightly into all indentations on the meat as the outer bag was evacuated. As a result, the before described pockets of air resulted where bacteria could grow faster. In other words, the reduction of one problem (bone tears) caused an increase of the other problem (bridging with increased bacteria growth in air pockets). A more detailed discussion of this problem will be given when referring to FIG. 2 of the drawings.

SUMMARY OF THE INVENTION

In order to overcome the before described problems, there has been achieved by the applicant's new bone plastic cap a totally new approach to the problem. The applicant's novel solution, in the preferred embodiment, provides a cushion device which is preformed out of an ultra low density polyethylene (ULDPE) plastic into the approximate shape of at least a portion of the meat to be covered. The preformed cushion also has preformed concave areas that correspond to the contours of the meat surface. The preformed bone plastic cap is formed of a collapsible plastic material which will both cushion the exposed portions of bone and will also collapse into the concave areas of indentation on the meat during the vacuum sealing of the outer bag. The collapse of the bone plastic cap eliminates the pockets of air and also the bridging problems previously discussed. Novel means have been incorporated on the applicant's bone plastic cap to insure that no entrapped air is left and that evacuation of all air is complete thereby insuring a good vacuum sealed product.

In one embodiment of the invention, this novel solution to the multiple problem is obtained using a collapsible bone plastic cap which is formed in at least two separate juxtaposed shapes with each shape having an outer flange, with adjacent flanges being fixed together at spaced intervals. By fixing the flanges together at spaced predetermined intervals, entrapped air may be more easily evacuated from between the two separate juxtaposed shapes.

In addition, each preformed shape has means for releasing entrapped air in the form of holes or slits cut through both shapes at spaced distances. With the use of separate preformed shapes of the type of plastic material before described in combination with the holes or slits in the preformed shapes and the use of outer flanges which are fixed together at spaced intervals, the prior art problems are completely solved.

The inner preformed shape will first encapsulate the exposed sharp bone edges and/or points while the outer preformed shapes are free to slide or move independently as each shape collapses over the meat whenever the outer vacuum sealed bag is applied. This will be discussed more fully hereinafter, especially when referring to FIGS. 3-7 of the drawings which show the applicant's novel product.

By using at least two separate preformed juxtaposed shapes of approximately 0.005 to 0.008 inches thick, the appropriate bone cushioning is obtained as well as the elimination of air pockets since both preformed thin and flexible shapes will totally collapse in the concave areas of indentation during vacuum sealing of the outer bag and will not bridge across the crevice or larger cavities.

Accordingly, it is an object and advantage of the invention to provide a new and novel plastic bone cap which will provide the necessary toughness to cushion exposed bone and which will also provide the necessary flexibility to collapse onto all the areas of the meat thereby eliminating pockets of entrapped air where increased bacteria growth can occur.

Another object and advantage of the subject invention is to provide a new and improved plastic bone cap which has improved shrinkability so that when run through existing heat tunnels of approximately 195 degrees Fahrenheit for approximately 6 seconds and respond by further tightening itself against the surface of the meat.

Another object and advantage of the invention is the aesthetic quality of clarity that it adds to the package. The meat may now be clearly seen through the vacuumed package, which was not the case with the wax impregnated cloth or reinforced laminated bags commonly used.

Still another object and advantage of the subject invention is to provide a new and novel cushioning device that is formed out of separate sheets of material with holes or slits with the sheets having low slippage therebetween and with the separate preformed shapes being tacked together in a manner that will permit entrapped air to be easily evacuated from between the sheets while still permitting the preformed shapes to function as a unit.

It is believed that the first of these sheets to make contact with a bone point will encapsulate it and permit the second sheet to locate itself over the same bone point but without the inherent stress that exists with the sheet that first made contact with the bone. The absence of such stress makes the second sheet less vulnerable to puncture. A third sheet, if used, would react similarly to the second in positioning without stress as well as the protection of another gage thickness. The three-ply modification, as shown in FIG. 11, would be an option reserved only for the most extremely difficult bone frequency and sharpness.

Still another unique and novel feature is incorporated in the invention to allow expansion by means of corrugations and pleats positioned as later shown in the drawings to accommodate larger than average cuts of meat. The expansion means may be used with all of the variations of the invention as will be described.

In yet another object and advantage of the invention, the basic concept may be used in a single sheet configuration which functions like the before described multiple sheet versions to completely encapsulate exposed sharp bone edges and to minimize bacterial growth in the meat package.

These and other objects and advantages and modifications of the subject invention will be clearly seen when studying the accompanying drawings and when reading the following Description of the Preferred Embodiment which has been given by way of illustration only.

DESCRIPTION OF THE PREFERRED EMBODIMENT

Figure 1:
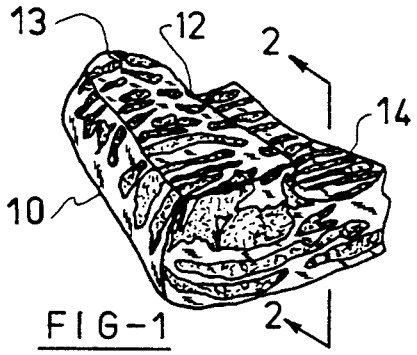
FIG-1 PRIOR ART
FIG. 1 is a perspective view of a typical large cut of meat of the before described type having exposed bone portions and having a concave area of indentation.

Referring now to the drawings in general and in particular to FIG. 1 of the drawings there is shown in a perspective view, generally by the numeral 10, a typical large cut of meat of the type which may be shipped to a supermarket for cutting into smaller portions by the local butcher. The meat cut 10 may have a line 12 of exposed bone portions as well as a line 14 of similar bone portions. Exposed portions of bone may also be found in the top area 13. Other types of large meat cuts may also have exposed bone portions or ends in different locations which can pierce the outer vacuum sealed plastic bag in which the meat cut would be packaged for shipment to the wholesale distributor or supermarket.

Figure 2:
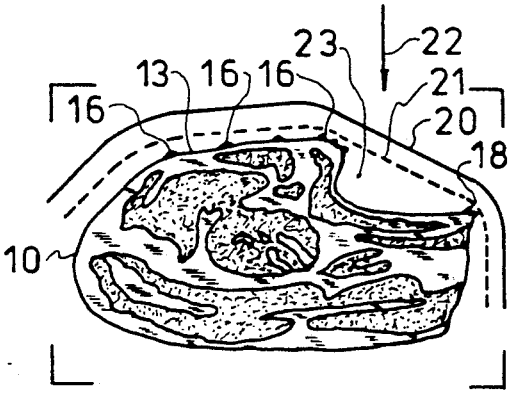
FIG-2 PRIOR ART
FIG. 2 is an end elevation view, taken along line 2—2 of FIG. 1 showing one prior art type of cushioning device in dotted lines applied over exposed portions of bone.

Referring now to FIG. 2, there is shown an end elevation view, taken along line 2—2 of FIG. 1, showing how one type of prior art cushioning has been used in the past and is positioned over the exposed bone lines 12 and 14. In FIG. 2, the exposed bone has been shown enlarged for purposes of clarity and the pieces of bone 16 would lie along the bone line 12 and in the top area 13 while pieces of bone 18 would also lie along the bone line 14. As previously discussed, a beeswax coated material 20, approximately 14 mil thick, would often be positioned as shown in FIG. 2 by the arrow 22 and would be placed over the pieces of bone 16 and 18 as shown by the dashed line 21. The wax impregnated cloth sheeting does pull in tightly and protects from the piercing by the sharp bones to a degree. However it has application and visual disadvantages as compared to the applicant's novel improvement.

The wax impregnated cloth is labor intensive in application when compared to the fast and efficient capping on of the applicant's product. The visual disadvantage is that the wax sheet does not possess clarity to permit viewing of the meat in the area 23 beneath the cloth sheeting.

Figure 3:
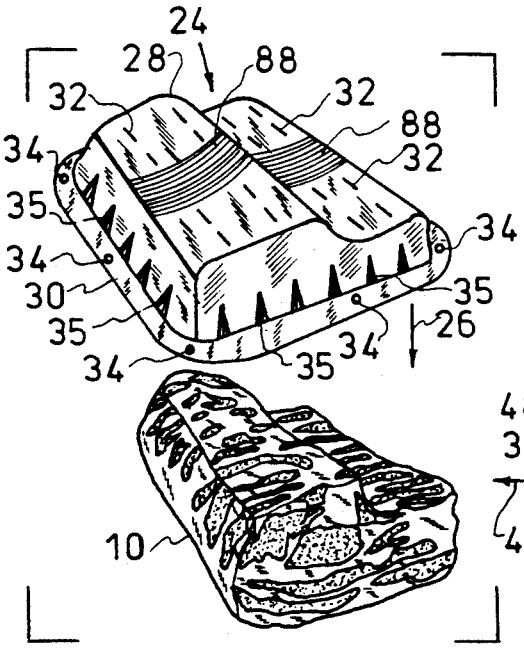
FIG. 3 is a perspective view of the cut of meat shown in FIG. 1 showing the applicant's novel bone plastic cap positioned on top of the cut of meat prior to being positioned over the areas of exposed bone with the expansion means in the form of corrugations and pleats also being shown.

Referring now to FIG. 3 there is shown in a perspective view, the typical large cut of meat 10 with the applicant's new and novel bone plastic cap in the two sheet embodiment, shown generally by the numeral 24. The cap is shown on top of the meat 10 prior to its being placed over the meat in the direction of the arrow 26. The novel bone plastic cap 24 is formed in the approximate shape of the meat to be covered. The formation of the shape is by known plastic forming techniques which are not a part of this disclosure. The cap 24 is formed in the embodiment shown in FIG. 3 with at least two separate juxtaposed preformed shapes having outer flanges which are fixed together at predetermined positions and for reasons which will be discussed more fully hereinafter.

In FIG. 3 the outer preformed shape can be seen and comprises a first outside central preformed panel 28 formed out of a resilient plastic material in the approximate shape of the portion of meat to be cushioned. A first outer flange 30 is formed on the central panel 28 around the periphery of the panel. The flange strengthens all of the sides of the preformed central panel 28 with sufficient rigidity to facilitate the bone plastic cap 24 standing up and being capable of easy nesting in the plastic forming plant, shipping and easy de-nesting by the line workers in the meat packaging plants. Expansion means in the form of vertical pleats 35 may be formed around the sides where shown and expansion means in the form of corrugations 88 may also be formed as shown and in other directions. The expansion means will be discussed in more detail hereinafter when referring to FIG. 8 of the drawing.

The applicant's plastic bone cap 24 has a series of holes or slits 32 through the central panel 28 which serve as the second means for releasing entrapped air from around the meat 10 and from between the juxtaposed panels as will be discussed more fully hereinafter. These holes or slits 32 would be formed with a piercing awl or some other suitable type piercing tool.

Figure 4:
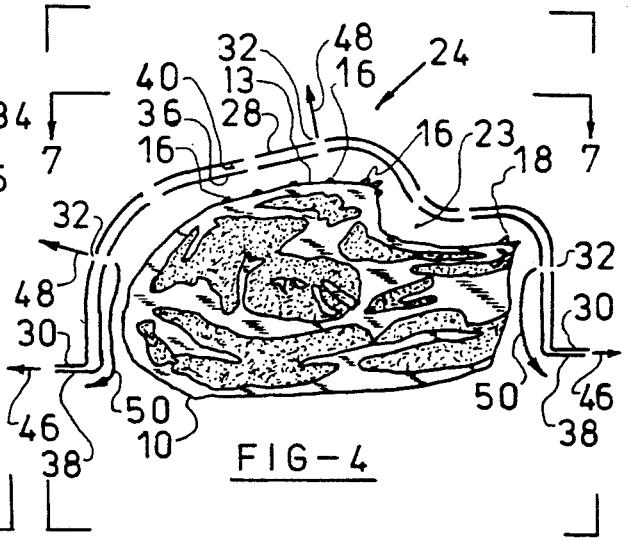
FIG. 4 is an end elevation view, similar to the view of FIG. 2, showing the applicant's two sheet version of the bone plastic cap in place and showing the two separate preformed shapes of plastic in juxtaposition to each other and to the cut of meat.

Referring now also to FIG. 4, there is shown an end elevation view, similar to the view of FIG. 2 but showing in enlarged detail the applicant's novel bone plastic cap 24 positioned over the meat portions to be cushioned. It can be seen in FIG. 4 how the two-piece variation of the bone plastic cap 24 may be formed in the preferred embodiment in at least two preformed shapes. The inner shape is formed with a second inside central panel 36 similar in size and shape to the first outside central panel 28. A second outer flange is also formed around the periphery of the sides and the inner shape and is fixed to the first outer flange by heat tack welding at 34 as shown in FIG. 3 or by some other suitable means.

The tacking or fastening together of the inner flange 38 to the outer flange 30 at predetermined spaces forms the first means to fixedly attach the flanges together. By fixing the flanges at predetermined intervals, entrapped air may also be evacuated from between the first and second panels 28 and 36 in the untacked spaces as will be more fully detailed later when referring to FIGS. 5–7 of the drawings.

FIG. 4 has been drawn in an enlarged detail to show more clearly the two-piece construction of the bone plastic cap 24 with the panels 28 and 36. They are nested together with their outer flanges 30 and 38 tacked together at 34. When positioning the complete plastic bone cap 24 over the meat 10 the purpose of the design is to fit and correspond as nearly as possible to the contoured surface of the meat and to cover all exposed bone areas. Since all of the cuts of meat are not precisely the same size and form and the exposed bone pieces 16 and 18 are not always exposed where shown on different cuts of meat, designs must be customized for each standard configuration.

In FIG. 4 there can also be seen how both the outer central panel 28 and the inner central panel 36 have the holes or slits 32 formed therein. As the evacuation of air starts during the vacuum sealing of the outer bag, entrapped air is removed as shown by the arrows 46, 48 and 50 in the directions shown. Entrapped air between the panels 28 and 30 can be removed through the holes or slits 32 outwardly in the direction shown by the arrow 48. The entrapped air can also be removed inwardly towards the meat 10 as shown by the arrow 50. In a similar manner, this entrapped air can also be removed by passing between the outer flange or skirt 30 and the inner flange or skirt 38 through the untacked spaces as shown by the arrow 46.

The materials used in the preferred embodiment of the bone plastic cap should be ultra low density polyethylene (ULDPE) transparent food grade plastic. Each central plane 28 and 36 as well as the flanges 30 and 38 would be formed from sheets approximately 0.005 to 0.010 inches thick. This type of material and thickness permits the inside plastic panel 36 to make contact with and encapsulate the exposed bone and to collapse without bridging across cavities and crevices owing to its thin gage and exceptional inherent flexibility. The outer panel 28 would almost simultaneously follow the inside panel 36 but would not be held in stress but rather more readily conform with minimal tension over the sharp bones and inner sheet.

While emphasis has been made in this discussion of the elimination of bridging over the area 23, it should be noted that the area 23 shown may be only one of many such areas in the large meat cut depending upon the type of cut. These areas of air entrapment are all generally concave in some shape or may also be seen as indentations in the overall outline of the meat. By the use of the applicant's novel bone plastic cap 24 formed as described with the mateials typified in the two-piece embodiment and other embodiments to be described hereinafter, the novel cap is designed both to cushion and to collapse into these troublesome areas during vacuum sealing of the outer plastic bag.

Figure 5:
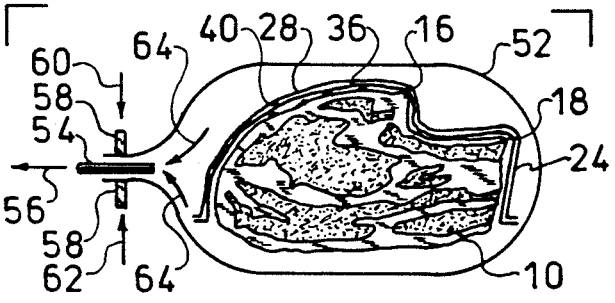
FIG. 5 is a reduced end elevation view, similar to the view of FIG. 4, showing the outer vacuum sealed plastic bag positioned around the previously covered cut of meat of FIG. 4 and showing the outer plastic bag at the start of the evacuation process.
Figure 6:
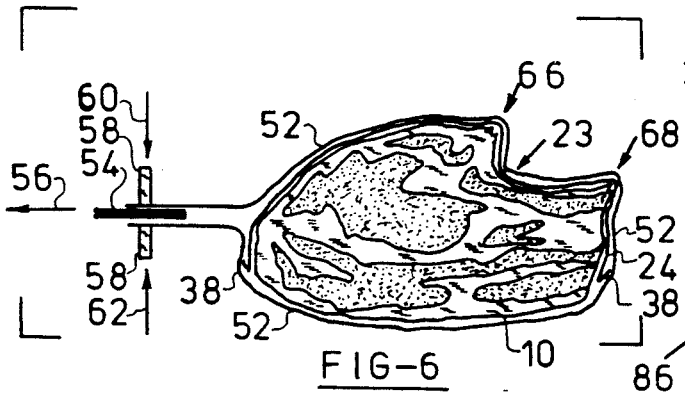
FIG. 6 is a view similar to the view of FIG. 5 showing how the outer plastic bag collapses on the applicant's bone plastic cap which in turn collapses on the cut of meat as the evacuation process is completed to eliminate the before described bridging.

FIGS. 5 and 6 show in detail how this occurs. FIG. 5 is a reduced end elevation view, similar to the view of FIG. 4. It is not drawn in enlarged detail but is drawn closer to an actual representation with the preformed bone plastic cap 24 shown as it would be when placed on top of the meat 10. As before described, after the meat is cushioned with the applicant's novel bone plastic cushion 24, the large meat cut is then positioned by known techniques on the inside of an outer plastic bag 52 which has its open end placed over an air evacuation device 54.

Air is then evacuated in the direction shown by the arrow 56 from the open end of the bag 52 until a vacuum in the range of approximately 20 to 25 inches of mercury is obtained. A heated pressure sealing device 58 then seals the bag end with pressure being applied to the bag end in the direction shown by the arrows 60 and 62. As the evacuation device 54 withdraws air inside the bag 52, as shown by the arrows 64, the outer bag begins to collapse.

Since the inner central panel 36 is formed separate from the outer central panel 28 with a space 40 therebetween, the panels are free to slide over each other as the outer bag collapses and forces the panels 36 and 28 to take the shape of the meat 10. Since this occurs rather rapidly and can not be easily documented, it is believed that the sliding of the two central panels permits the inner panel 36 to first form itself over the exposed bone pieces 16 and 18 as the primary cushion against piercing of the outer bag 52. The outer panel then is believed to be a secondary cushion which is formed somewhat later in time, although probably only a split second later.

It is believed that this occurs as described since the outer bag 52 will first collapse onto the outer central panel 28 which in turn then collapses onto the inner central panel 36. With the particular plastic used in the thicknesses given, the total collapse in the area 23 eliminates the bridging before described between the areas 66 and 68 as shown in FIG. 6. The total collapse in the area 23 as well as in all the concave areas of identation on the meat is shown in FIG. 6 which is a view similar to the view of FIG. 5 but represents the outer bag 52 and the inner bone plastic cap 24 totally collapsed after the proper vacuum is obtained. In FIG. 6, the applicant's novel bone plastic cap 24 has been shown in single line for purposes of clarity and only the second outer flanges 38 have been shown to illustrate that they, as well as the first outer flange 30, also collapse or are bent as shown under the vacuum in the bag 52. The applicant's novel transparent bone plastic cap forms itself so tightly over the meat 10 that it is virtually invisible through the outer plastic bag 52. This means that the entire cut of meat can be observed and no areas are hidden by cushioning material.

Figure 7:
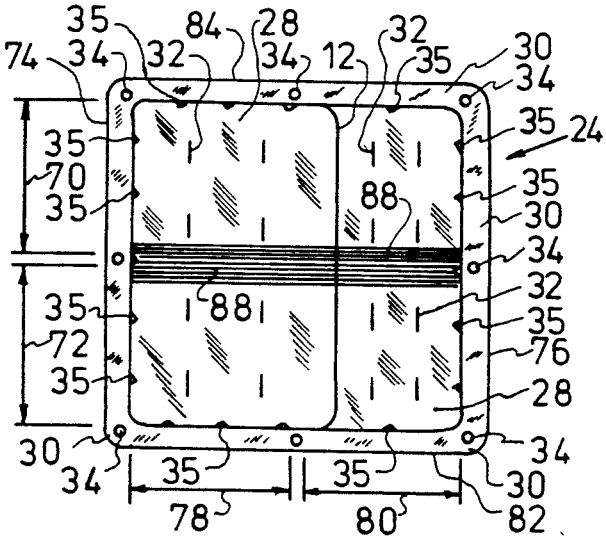
FIG. 7 is a top plan view, taken along line 7—7 of FIG. 4, showing in detail the holes or slits cut through the inner and outer preformed shapes of the applicant's device and also showing how both shapes are fixed or tacked together at predetermined spaces to allow entrapped air to be evacuated from between the separate forms through the non-tacked spaces. The expansion means in the form of corrugations and pleats can also be clearly seen.

Referring now to FIG. 7 there is shown a top plan view, taken along line 7—7 of FIG. 4, detailing the position of the holes or slits 32 cut through the outer panel 28 as well as the inner panel 36. FIG. 7 also details more clearly the spacing 70 and 72 of the tacking 34 along one pair of opposite sides 74 and 76 and the spacing 78 and 80 along the other pairs of opposite sides 82 and 84. Since areas 70, 72, 78 and 80 around the entire periphery of the flanges or skirts 30 and 38 are not tacked or are unsealed, entrapped air may be easily evacuated by the vacuum device 54 as before described. The spacing and total number of tacks would be determined according to the size and shape of the bone plastic cap. While eight tacks have been shown in the FIG. 7 shape, more or less may be used within the spirit and scope of the invention.

Figure 8:
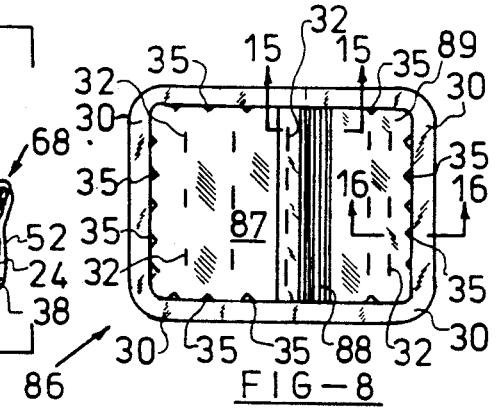
FIG. 8 is a reduced top plan view, similar to the view of FIG. 7, showing another embodiment of the applicant's novel bone plastic shield formed in a single sheet and also formed with expansion means using corrugations and pleats.

Referring now to FIG. 8 there is shown a reduced top plan view, similar to the view of FIG. 7, showing another embodiment of the applicant's novel plastic bone cap, which is formed in a single sheet and is also formed with expansion means using corrugations 88 and pleats 35. The modified form, shown generally by the numeral 86 has been shown with the expansion pleats 35 and corrugations 88 which provide for expansion of the modified bone plastic cap 86 outwardly to accommodate oversized meat cuts without tearing the cap. Further details on these features will be discussed hereinafter when referring to FIGS. 15 and 16 of the drawings.

Figure 9:
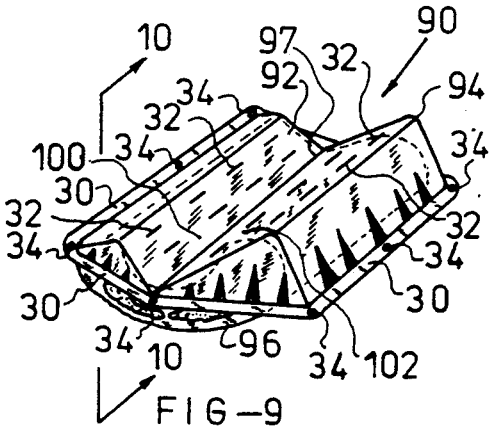
FIG. 9 is a perspective view of a different cut of meat and showing still another form of the bone plastic cap applied over portions of the meat.
Figure 10:
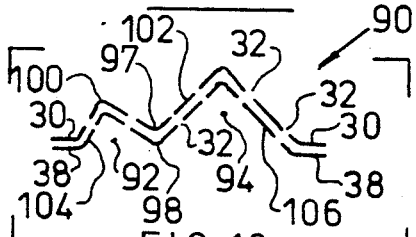
FIG. 10 is an end elevation view, taken along line 10—10 of FIG. 9, showing in more detail the construction of the modified form of the bone plastic cap formed in two separate shapes, which are hinged together.

Referring now to FIG. 9 there is shown a perspective view of a different type of meat cut as shown by the numeral 96 which may be a short loin or similar cut of meat. When using the applicant's novel invention a modified bone plastic cap 90 would be formed with two differently formed shapes 92 and 94 to cover different areas of the loin. A hinge line 97 would be formed between the first outside central panel 100 and the first outside central panel 102. The modification 90 of the applicant's basic invention may also have an inner two shaped panel construction as can be seen in FIG. 10 with a second inside central panel 104 lying in juxtaposition to the outer central panel 100. Similarly the second inner panel 106 would lie in juxtaposition to the outer central panel 102 with both panels 104 and 106 also being separated by a hinge line 98. The modification 90 may also be formed in a single sheet construction and in a triple sheet construction within the spirit and scope of the invention.

Figure 11:
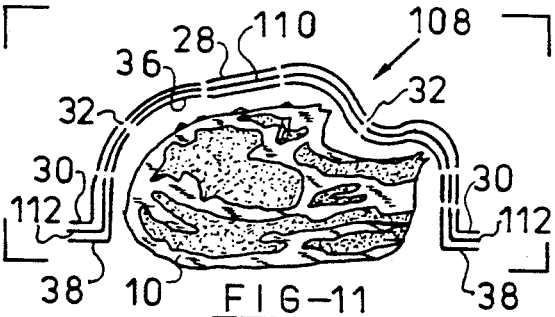
FIG. 11 is an end elevation view, similar to the view of FIG. 4, showing still another modification of the applicant's novel bone plastic cap formed with at least three separate juxtaposed similar shapes which are tacked together at predetermined intervals along the peripheral flanges.

The modified bone plastic cap 90 would also be formed with the first attaching means 34 and the air releasing means 32 formed through both panels and the inner and outer flanges 38 and 30 as before described. When formed in a single sheet configuration, the first attaching means would be eliminated and the air releasing means 32 would be used. While the preferred embodiment 24 and the modified form 90 of the plastic bone cap have been shown and described as having two separate thicknesses of plastic, it is within the spirit and scope of the invention that one to three or more thicknesses of plastic may also be desirable. FIG. 11 shows another modified device 108 with a first outer central panel 28 and a second inner central panel 36 having a middle central panel 110 positioned therebetween. The middle central panel 110 also contains an outer flange 112 around the periphery thereof which would be tacked to the flanges 30 and 38 as before described in predetermined places. In addition, the middle central panel 110 as well as the panels 28 and 36 have the holes or slits 32 formed therein to release entrapped air.

Figure 12:
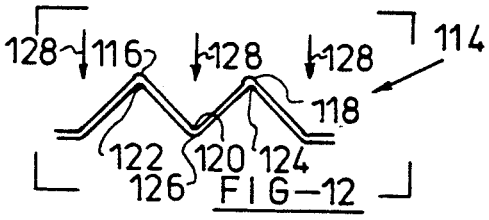
FIG. 12 is an end elevation view, similar to the view of FIG. 10, showing yet another modification of the applicant's novel bone plastic cap.
Figure 13:
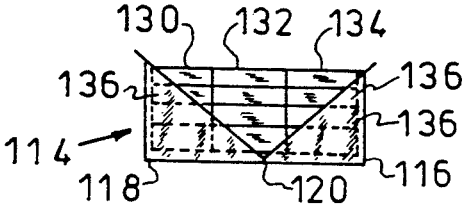
FIG. 13 is an end elevation view of the modifications of FIG. 12 showing how it is inverted and used as a tray to hold three rows of four each packages of another cut of meat.

Turning now to FIGS. 12 and 13 there is seen another modified form of the invention shown generally by the numeral 114 formed with two separate outside central panels 116 and 118 separated by an integral hinge line 120. Positioned inside thereof are a second pair of separate inside central panels 122 and 124 separated by an integral hinge line 126. The modified plastic bone cap 114 would be formed as shown in FIG. 12 in the direction shown by the arrows 128 and would be used to enclose three separate rows 130, 132, and 134 of four short ribs 136 more or less after being inverted and set up as a tray. This can be seen in FIG. 13 with the approximate twelve short ribs 136 contained in the package. If desired, the entire package of approximately twelve short ribs 136 may also be positioned in an outer vacuum sealed plastic bag 52 in which case the holes or slits 32 shown in FIG. 7 would be used with the spaced tacks 34 as before described to evacuate entrapped air.

Figure 14:
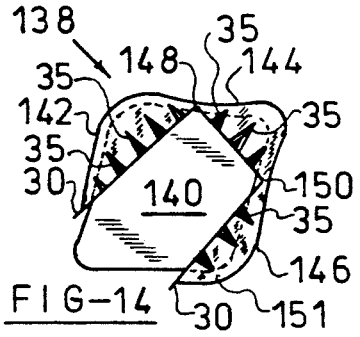
FIG. 14 is an end elevation view, similar to the view of FIG. 9, showing still yet another modification of the applicant's novel bone plastic cap formed in three separate hinged shapes for positioning over a much larger size of meat of a different cut.

Referring now to FIG. 14 of the drawings, there is shown an end elevation view, similar to the view of FIG. 9, showing still yet another modification shown generally by the numeral 138. Here a different cut of meat, such as a split chuck arm 140, requires the cushioning of three primary bone areas. The modified hinged design contains three differently formed shapes 142, 144 and 146 which are separated by two hinge lines 148 and 150. The flattest of the three molded shapes 146 is hinged down and tucks under the round bone side at 151.

The applicant's basic design features shown in the preferred embodiment 24 would also be employed in the modified form 138 and will not be reviewed at this time for purposes of brevity. However, it should now be clear that the basic novel invention may be used on all types of meats such as beef, lamb, pork, poultry and other as well as on other shapes all within the spirit and scope of the invention.

Figure 15:
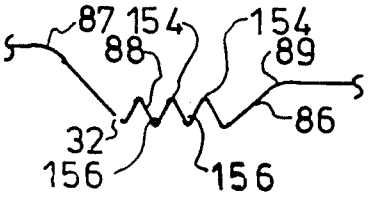
FIG. 15 is a cross-sectional elevation view, taken along lines 15—15 of FIG. 8, showing further details of the corrugation expansion means that may be used on a single sheet embodiment of the invention as well as on the multiple sheet forms.
Figure 16:
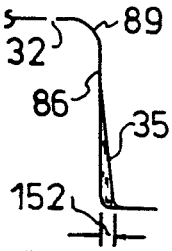
FIG. 16 is a cross-sectional elevation view, taken along lines 16—16 of FIG. 8 showing further detail of the pleat expansion means that may be used on a single sheet embodiment of the invention as well as on the multiple sheet forms.

Referring now to FIGS. 15 and 16 there will be described in more detail the expansion means in the form of the pleats 35 and the corrugations 88. FIG. 15 is a cross-sectional elevation view, taken along lines 15—15 of FIG. 8, showing how elongated corrugations 88 may be used on the single sheet version 86. These corrugations 88 and/or pleats 35 may also be desired on the multiple sheet versions and it can be seen how the corrugations 88 may be used in a different direction by referring to FIG. 7.

In order to accommodate larger cuts of meat that may occur at various times of the year, the use of elongated corrugations 88 may be incorporated into all of the plastic bone cap versions if desired. It is known that certain cuts of meat may vary as much as 15% over the standard size, as for example in the lamb industry where the lambs are traditionally fed more in the fall to make them larger. When such oversize conditions occur, the use of the corrugated expansion means 88 may be desirable.

When this occurs, parallel corrugations of peaks 154 and valleys 156 may be used to span the upper surface of some cuts of meat. The corrugations 88 would then allow an accordion action stretch to accommodate the larger cuts.

When a smaller expansion is desired, then the expansion pleats 35 may be used by themselves or in combination with the corrugations 88. FIG. 16 is a cross-sectional elevation view, taken along lines 16—16 of FIG. 8 and shows the pleat expansion means 35 used on the single sheet version of the applicant's novel bone cap. The pleats 35 are formed more or less vertical and are incrementally placed around the perimeter of the bone cap to also permit expansion of the bone cap outwardly to accommodate slightly oversized meat cuts. The pleats 35 may be formed as shown with a lower recess of approximately 0.1 inch dimension as shown by the numeral 152 in FIG. 16. This would allow a stretch of the bone cap of approximately ½" around the periphery of a typical bone cap of the type shown.

The expansion means using pleats 38 and/or corrugations 88 may be used on the single sheet versions of the applicant's invention as well as on the multiple sheet versions. In addition, where deeper undercuts of meat are to be packaged, additional slits 32 may be required in special areas to allow the plastic material to break away in bridge areas where the undercut is deep.

Figure 18:
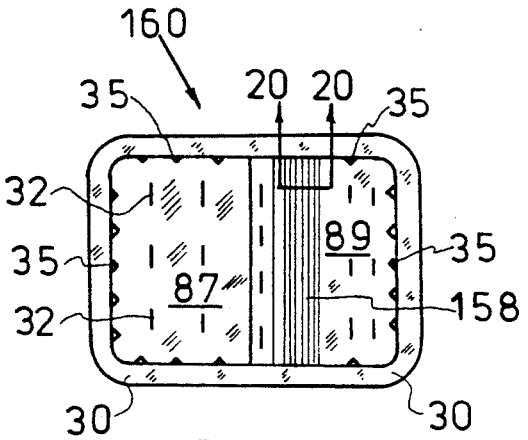
FIG. 18 is a reduced top plan view, similar to the view of FIG. 8, showing a modification of the expansion means running in one direction.
Figure 19:
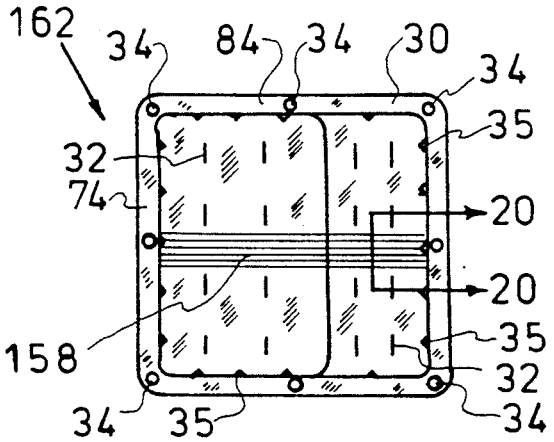
FIG. 19 is a top plan view, similar to the view of FIG. 7, showing the modified expansion means running in a different direction.
Figure 17:
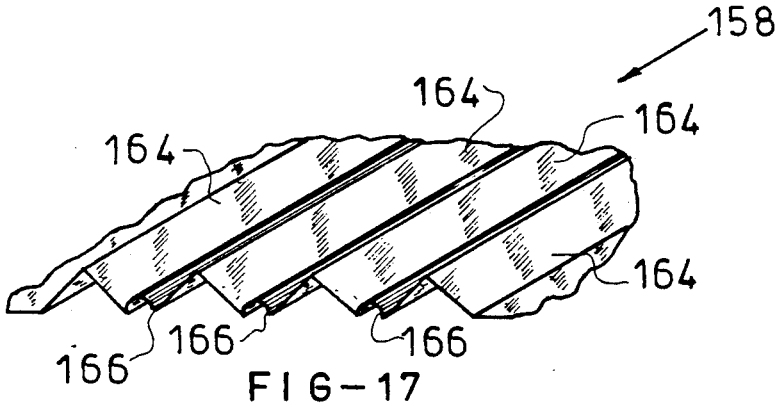
FIG. 17 is a perspective view of a modified expansion means used on the applicant's plastic bone cap.

Referring now to FIGS. 17-20, there are shown in detail new and novel modifications to the ribs or corrugations as before described. These ribs are used as expansion means to accommodate the oversize cuts of meat to be protected by the plastic bone cap. FIG. 17 is a perspective view of a modified structure shown generally by the numeral 158, which has improved expansion capabilities obtained from its novel design. The modification shown in FIG. 17 may be used on a modified plastic bone cap 160 with expansion means running in one direction as shown in FIG. 18. The modification may also be used on a modified plastic bone cap 162 with the expansion means running in the other direction as shown in FIG. 19 of the drawings.

The applicant's improved expansion means 158 comprises a series of first expansion areas 164 alternating with a series of second expansion areas 166. The first and second expansion areas 164 and 166 are joined together as shown and are formed by molding when the plastic bone cap is manufactured. In the molding process, the smaller expansion areas 166 are formed to provide a constant thickness of plastic in the lower areas shown to help insure the integrity of the bone cap in the expansion area. In the formation of the expansion means 164 and 166, the space between the adjacent areas 164 require special care in molding to prevent the plastic from becoming too thin in this area. The use of the small expansion area 166 such as the semi-circle area thereby provides the necessary plastic to prevent this area of the expansion means from becoming too thin.

Figure 20:
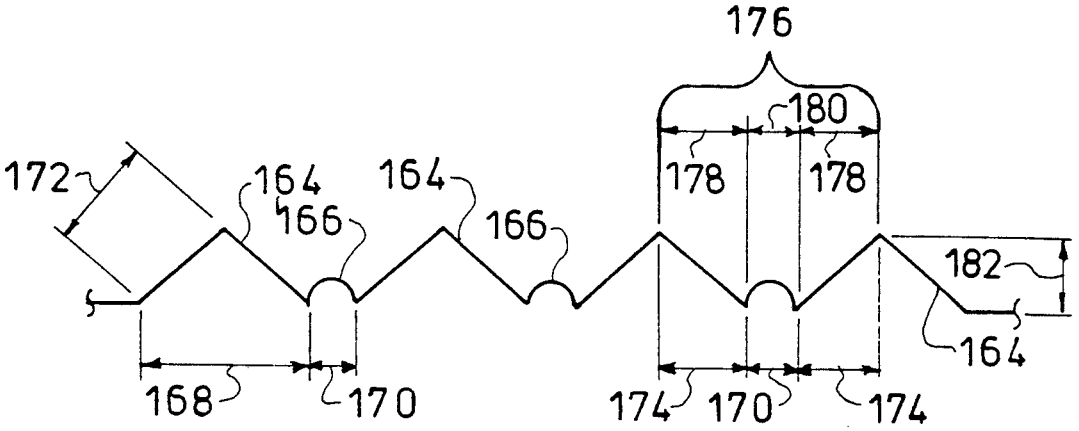
FIG. 20 is a cross sectional view, taken along lines 20—20 of FIG. 18 and 19 showing in further detail the construction of the modified expansion means.

Referring now to FIG. 20, there is shown a cross-sectional view, taken along lines 20—20 of FIGS. 18 and 19. The first expansion area 164 is formed in an inverted V-shaped configuration while the second smaller expansion area 166 is formed in a semi-circular configuration in the embodiment shown.

The base length 168 of a typical design for the first expansion area 164 would be approximately 0.75 inches while the diameter 170 of the second expansion area 166 would be approximately 0.25 inches. The use of the second expansion area 166 between the separated first expansion areas 164 insures that the peak-to-peak ratio of plastic is maintained and held constant throughout the expansion means. By separating the larger adjacent first expansion areas from each other, more plastic is able to flow to the bottom of the base of the two adjacent inverted V-shaped configurations. This insures uniform plastic thickness in this lower area during the molding process of the formation of the plastic bone cap.

The length of the sides 172 of the inverted V-shaped triangle would preferably be 0.5 inches in the embodiment shown. From the use of this configuration, the non-expanded length, shown by the numerals 174, 170 and 174 would be respectively 0.375 inches, 0.25 inches and 0.375 inches for a total length of 1.0 inches.

As the bone cap would need to be expanded for a larger size of meat cut, the configuration shown would then be able to be expanded to the length of 1.39 inches, shown by the numeral 176 in the drawing view. This expanded distance is obtained from the lengths shown by the numerals 178, 180 and 178 as the grouping is stretched out flat when the bone cap is positioned over the meat cut. The lengths shown by the numeral 178 are approximately 0.5 inches and are the same length as the length shown by the numeral 172 on the side of the triangle. The length 180 is one-half of the circumference of the semi-circular configuration shown.

When the inverted V-shaped triangles are formed with a height of approximately 0.35 inches and in the basic configuration shown, an improved expansion means is obtained without sacrificing integrity of the plastic in the lower area of the expansion ribs. This design will then accommodate a large variety of oversized meat cuts thereby making the applicant's improved bone cap more usable regardless of the size of meat to be covered. By varying the configurations and the number of different sizes of expansion areas, a wide variety of overall expansion length is obtainable in either or both directions of the bone cap.

While the number of inverted V-shaped configurations in combination with the semi-circular areas may vary from cut to cut of meat, the usual combination will be around six in number for smaller cuts of meat. For larger cuts of meat the number of combinations will range up to twelve or fifteen to provide the necessary expansion over the meat.

The configuration of an inverted V-shaped area and a small semi-circular area in alternating or repeating patterns has proven successful in field trials. Other patterns and configurations are also possible within the spirit and scope of the applicant's invention. For example a smaller inverted V-shaped configuration may be used to replace the semi-circular area and the larger expansion area may also be formed in a semi-circular configuration within the scope of this invention.

From the foregoing it can be seen that there has been provided a unique bone plastic cap that may be formed in one sheet or in multiple sheets, with the various versions accomplishing all of the objects and advantages of the invention as well as many others. While the embodiments shown and described have been given by way of illustration only, the applicant is not to be limited in his patent to these embodiments and other modified forms as shown of the basic novel concept which are considered to be within the spirit and scope of the invention.

Having described my invention, I claim:

1. In a package of meat of the type having-exposed portions of bone, and concave areas of indentation where package bridging may occur with the meat contained in a separate outer vacuum sealed transparent bag and having a separate preformed bone plastic cap cushion device with vertical sides, and horizontal surfaces positioned over at least exposed portions of bone, the separate cushion device functioning to prevent the exposed portions of bone from piercing the separate sealed bag thus destroying the vacuum seal of the bag, the separate cushioning device also functioning to collapse into the concave areas when the separate outer bag is vacuum sealed to thereby purge entrapped air from the areas of indentation, the separate cushioning device also functioning to handle meat which may be larger than other meat sizes, the improvement comprising:

(a) the separate cushion device comprising a separate preformed bone plastic cap which has an approximate shape of at least the exposed portions of bone and an approximate shape of the concave areas of indentation;

(b) the separate preformed bone plastic cap being formed of a collapsible tough and resilient plastic material which will cushion the exposed portions of bone and will collapse into the concave areas of indentation on the meat during the vacuum sealing of the separate bag, the collapse of the separate bone cap into the concave areas of indentation minimizing the bacterial growth in the concave areas as entrapped air is purged out of the area and out of the separate bag:

(c) the separate preformed bone plastic cap being formed with at least one sheet of collapsible plastic material; and (d) the cushion device being formed with expansion means permitting the cushion device to be expanded as needed when the device is positioned around meat oversize variations, the expansion means comprising a plurality of first expansion areas, each first expansion area being separated by and connected to a second adjacent expansion area formed of a different configuration than the configuration of the first expansion area, the first expansion area providing expansion and the second expansion area providing additional expansion.

2. The improvement as defined in claim 1 wherein the first expansion area is formed larger than the second expansion area.

3. The improvement as defined in claim 1 wherein the first expansion area is formed in a V-shape configuration and the second adjacent expansion area is formed in a semi-circular configuration.

4. The improvement as defined in claim 3 wherein a base length of the V-shape configuration is approximately 0.75 inches and the diameter of the semi-circular configuration is approximately 0.25 inches.

5. The improvement as defined in claim 1 wherein the expansion means further comprises a plurality of approximately vertically positioned rib corrugation pleats formed in approximately vertical sides of the cushion device.

6. The improvement as defined in claim 1 wherein the expansion means areas further comprise at least a plurality of horizontally positioned ribs formed in at least one of the horizontal surfaces of the separate preformed bone plastic cap cushion devices.

7. The improvement as defined in claim 1 wherein the expansion means comprises both a plurality of substantially vertically positioned rib corrugation pleats formed in the vertical sides of the cushion device and a plurality of horizontally positioned ribs formed in at least one of the horizontal surfaces of the separate preformed bone plastic cap cushion device.

8. The improvement as defined in claim 1 wherein the tough and resilient plastic is an ultra low density polyethylene plastic.

9. In a package of meat of the type having exposed portions of bone, with the meat contained in a separate outer vacuum sealed bag and with a separate preformed bone plastic cap cushion device positioned over exposed portions of bone to prevent the exposed bone portions from piercing the separate sealed bag thus destroying the vacuum seal of the bag, the improvement comprising:

(a) the separate cushion device comprising a separate preformed bone plastic cap being formed in the shape of at least a portion of the meat;

(b) the separate preformed bone plastic cap being formed in at least two separate juxtaposed shapes, each separate shape having an outer flange formed thereon with the outer flanges being fixed together at predetermined positions around a periphery of the flange;

(c) the two separate juxtaposed shapes having pierced therein means for releasing entrapped air around the meat and from between the two separate shapes as the outer bag is vacuum sealed;

(d) the two separate juxtaposed shapes and the releasing means in combination with the flanges fixed together at predetermined positions around the periphery of the flanges permitting the cushion device to collapse tightly around the meat and to cushion the exposed portions of bone as the separate bag is vacuum sealed, the two separate juxtaposed shapes permitting the shapes to slide across each other during the collapse as one shape and then the other shape forms itself around the exposed portions of bone thereby providing a double barrier to sharp bones and also preventing air from entrapping itself in the area of the exposed bone and any concave area of indentation and minimizing growth of bacteria on the meat which can cause spoilage of the meat; and (e) the separate cushion device is formed with first and second expansion means formed in at least a first and second connected juxtaposed shape permitting the separate preformed bone plastic cap cushion device to be expanded as needed when the device is positioned around meat having oversize variations which may be larger than other meat sizes, the first and second connected shapes providing expansion in the cushion device.

10. The improvement as defined in claim 9 wherein, the first and second connected shapes of the expansion means having a triangular shaped cross-section and a semi-circle shaped cross-section, respectively, which are joined together.

11. The improvement as defined in claim 9 wherein the separate preformed bone plastic cap is formed in at least two differently formed juxtaposed shapes for positioning over different areas of a same piece of meat, the two differently formed shapes being attached together along a hinge line.

12. The improvement as defined in claim 9 further comprising the separate preformed bone plastic cap being formed in at least three differently formed juxtaposed shapes attached together along hinge lines.

13. The improvement as defined in claim 9 wherein each of the two separate juxtaposed shapes are formed of an ultra low density polyethylene plastic.

14. The improvement as defined in claim 13 wherein the ultra low density polyethylene plastic is approximately 0.005 to 0.010 inches thick.

15. A separate preformed bone plastic cap for use over meat which is positioned inside of a separate outer plastic bag, the separate preformed bone plastic cap being used for positioning over predetermined portions of pieces of meat having exposed bones, the cap being used at a meat processing plant to cushion the exposed bone portion from piercing the separate outer plastic bag which is later placed around the separate preformed bone plastic cap on the meat and is vacuum sealed, comprising:

(a) a first outside central panel formed of a tough and resilient plastic and formed in the approximate shape of the portion of the meat to be cushioned, a first outer flange, formed around the periphery of the first outside central panel;

(b) a second separate inside central panel formed of a resilient plastic and also formed in the approximate shape of the first outside central panel and lying in juxtaposition with the first outside central panel, a second outer flange, formed around the periphery of the second inside central panel;

(c) first means, associated with the first and second flange, to fixedly attach the flanges together at predetermined spaced apart intervals along the flange; the fixation of the flanges at the predetermined spaced apart intervals permitting entrapped air to be evacuated between the spaced apart intervals and from between the first and second panels as the separate outer plastic bag is placed around the separate preformed bone plastic cap and is vacuum sealed;

(d) second means, associated with the first and second central panels, for releasing entrapped air from around the meat and from between the panels as the separate outer plastic bag is placed around the separate preformed bone plastic cap and is vacuum sealed;

(e) the first and second means along with the separate first and second central panels permitting the central panels of the separate preformed bone plastic cap to collapse tightly around the meat and to cushion the exposed bone portions with the first and second means permitting air to be evacuated prior to the vacuum sealing and not to be entrapped within the separate bag, thereby minimizing growth inside the bag; and (f) each first and second panels are formed with at least two differently shaped expansion means joined together to permit the panels to be expanded as needed when the separate preformed bone plastic cap is positioned around meat having oversize variations which may be larger than other meat sizes, each of the two differently shaped expansion means providing additional expansion.

16. The bone plastic cap as defined in claim 15 wherein the second means for releasing entrapped air comprises a plurality of holes positioned throughout the first and second central panels.

17. The bone plastic cap as defined in claim 15 wherein the first outside central panel and the second inside central panel are formed of an ultra low density polyethylene plastic sheet.

18. The bone plastic cap as defined in claim 17 wherein each plastic sheet is approximately 0.005 to 0.010 inches thick.

19. The separate preformed bone plastic cap as defined in claim 15 wherein the first and second central panels have formed in a vicinity of the outer flanges a plurality of second expansion means in a form of approximately vertical rib corrugation pleats permitting the separate preformed bone plastic cap to be further expanded as needed when positioned around oversized meat having a size somewhat larger than the size of the cap as formed.

20. The separate preformed bone plastic cap a defined in claim 15 wherein at least one of the central panels has formed therein the first expansion means in a form of horizontal alternating triangular and semi-circular shaped configurations joined together to permit the separate preformed bone plastic cap to be expanded as needed when positioned around much larger oversized meat than the size of the cap as formed.

21. The bone plastic cap as defined in claim 15 further comprising at least a third central panel formed and positioned between the first and second panel, the third panel constructed similarly to the first and second panel with an outer flange fixedly attached to the first and second outer flange and also having means for releasing entrapped air.

22. The bone plastic cap as defined in claim 15 further comprising the cap being formed in at least two differently formed shapes for positioning over different areas of the same piece of meat, and two differently formed shapes being attached together along a hinge line.

23. The bone plastic cap as defined in claim 22 further comprising the cap being formed in at least three differently formed shapes attached together along hinge lines.

* * * * *